US005895049A

United States Patent [19]

Fingers, Jr.

[11] Patent Number: 5,895,049

[45] Date of Patent: Apr. 20, 1999

[54] PUZZLE BUDDY

[76] Inventor: Edward Lee Fingers, Jr., 300 Vernon St., Marietta, Ohio

[21] Appl. No.: 08/942,785

[22] Filed: Oct. 2, 1997

[51] Int. Cl.[6] ..... A63F 9/10

[52] U.S. Cl. ..... 273/309; 273/157 R

[58] Field of Search ..... 273/153 R, 157 R, 273/148 R, 309; 206/315.1; 269/329

[56] References Cited

U.S. PATENT DOCUMENTS

| | | | |
|---|---|---|---|
| 703,558 | 7/1902 | De Ford | 273/157 R |
| 932,512 | 8/1909 | Strater | 273/157 R |
| 2,003,072 | 5/1935 | Eynon | 273/157 R |
| 2,448,667 | 9/1948 | Gainsley | 273/157 R |
| 3,458,216 | 7/1969 | Harrison | 273/309 |
| 4,479,651 | 10/1984 | LaFleur | 273/157 R |
| 5,624,118 | 4/1997 | Gottesman | 273/157 R |

*Primary Examiner*—Steven Wong
*Attorney, Agent, or Firm*—John P. Halvonik

[57] ABSTRACT

A reclosable lid with a playing surface for laying out of the jig saw puzzle pieces is shown and described. The playing surface includes: a pair of grooves and a pair of side rails for lateral support of puzzle pieces placed on the surface. The lid includes a layer of foamed material to maintain downward pressure on the puzzle pieces in place. Puzzles may then be safely stored for long periods of time within the confines of the playing surface and lid.

3 Claims, 2 Drawing Sheets

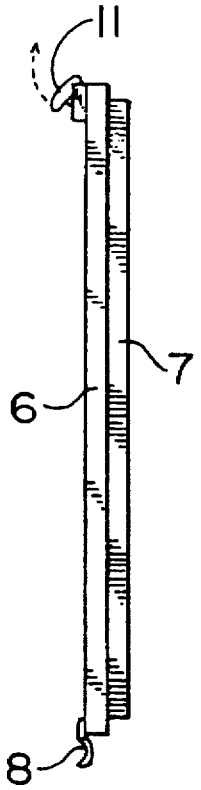
FIG. 2
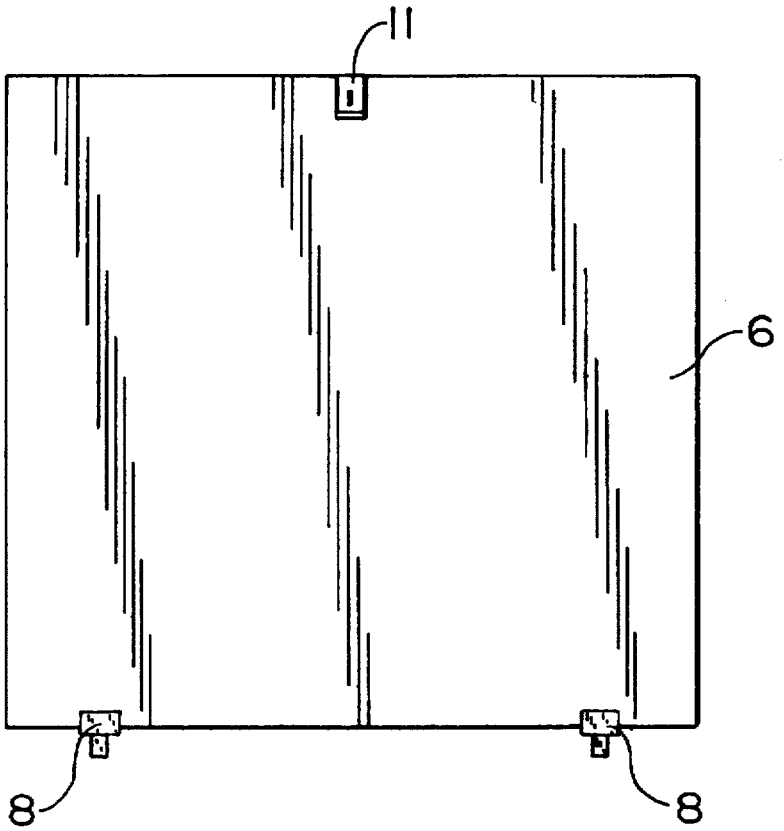
FIG. 1
FIG. 3
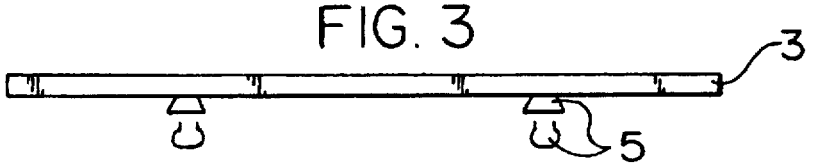
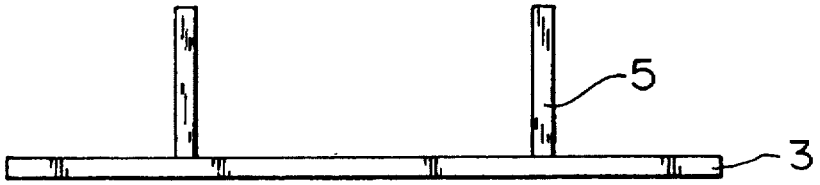
FIG. 4

PUZZLE BUDDY

FIELD AND BACKGROUND OF THE INVENTION

The invention relates to the field of games and in particular to a puzzle securing mean for safely storing and transporting jig saw puzzles that are partially completed or perhaps completed and mounted. The apparatus includes a box like construction that has a pivoting lid and side rails. The side rails may be adjusted by the user to hold the puzzle together with sideways support and the lid preferably has a foamed material layer in order that the lid can be clamped upon the puzzle in order to secure it in place with pressure from above.

There is found a need in the puzzle industry for a means for keeping uncompleted puzzles in place so that they may be safely stored when not in use. As the user may wish to place the partly completed puzzle away for an indeterminate period it becomes necessary to find an apparatus that can keep the puzzle pieces in the order that they go so that the user does not have to start all over again if he wishes to pick up the puzzle at a later time. With that end in mind, the applicant has provide a hinged box with a lid that will provide sideways support on the puzzle through the use of rails and also provide downward pressure on the puzzle when the lid is closed. With the use of the apparatus, a user may store the puzzle in partially completed fashion for an indeterminate time until he is ready to pick up the puzzle again. Such apparatus will keep the puzzle safely out of the way and allow the puzzle to be picked up again at a later date. While there are devices that are seen in the prior art that may be used in connection with puzzles none of the prior art is known to provide the advantages of the applicant's invention. None of the prior art is thought to use the idea of using sideways support to hold the pieces together nor does any of the prior art show the use of a padded lid in order to hold down the puzzle through downward pressure applied to the pieces.

SUMMARY OF THE INVENTION

The invention as shown and described includes a playing surface for laying out of the jig saw puzzle pieces, a pair of grooves in the playing surface, a pair of side rails and lid that is mounted for pivotal movement in connection with the surface. The side rails are used in connection with the grooves in order to provide a sideways support on the pieces of the puzzle that have been matched. The rails may be adjusted along the grooves in order to size them up with the sides of the puzzle. The lid includes a layer of foamed material in connection with one surface of the lid in order that the lid may be clamped down upon the puzzle pieces so that the pressure of the lid and the material will maintain the pieces in place. The apparatus also includes a lower lip or flange in connection with the bottom edge of the playing surface and also hinges and clamps for the lid that pivots in relation to the playing surface.

Once a jig saw puzzle has been completed or partially completed on the surface of the apparatus the side rails should be set in place to keep sideways support on the puzzle and the lid is moved downward and clamped into place against the pieces so as to prevent further movements. The puzzle may then be safety stored for long periods of time and/or safely transported. The apparatus may also be used to help permanently mount a completed puzzle through use of mounting materials such as adhesives and finishes.

It is among the objective of the invention to provide an apparatus for fixing in place an uncompleted puzzle so that those sections of the puzzle that have been completed may be safely transported and stored.

Another objective of the invention is to provide a mounting apparatus for puzzles that may be used to permanently mount the completed puzzle.

Other objectives will be known to those skilled in the art once the invention is shown and described.

DESCRIPTION OF FIGURES

FIG. 1 Top view of lid;

FIG. 2 Side view of lid;

FIG. 3 Side view of rail;

FIG. 4 Top view of rail;

DESCRIPTION OF THE PREFERRED EMBODIMENT

The various portions of the invention are shown in the figures. The planar surface or main work area is shown as 1. This surface may be of many different types of materials. Preferably the materials will be relatively permanent and may include: wood, plastics, possibly lightweight metals, for example. The surface should be more or less flat, or planar so as to accommodate jig saw puzzle pieces.

The planar surface may be equipped with a handle 9 and a clamp 11 for attaching the lid to the main work area. The clamp is one of various ways to attach the lid. The bottom edge of the planar surface should have a raised lip 2 so as to keep the puzzle pieces together and not fall off this edge. The preferred size of the surface would be about 32" square and about 1" thick. The lower lip or flange 2 should be equipped with markings for measurements.

Figure 5:
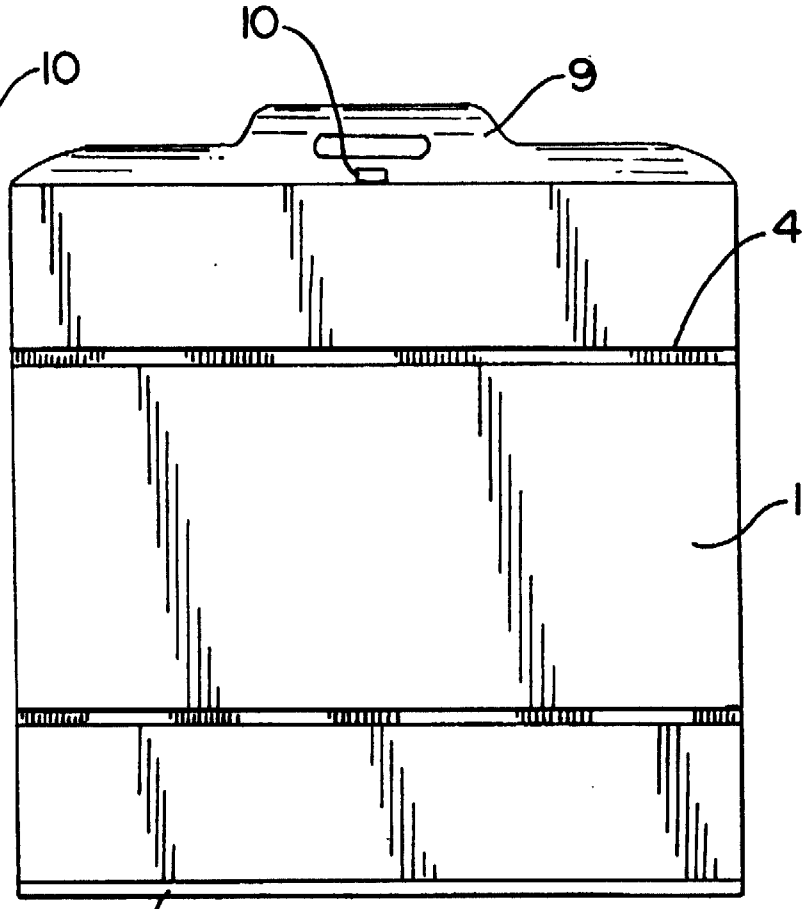
FIG. 5 top view of playing surface.
Figure 6:
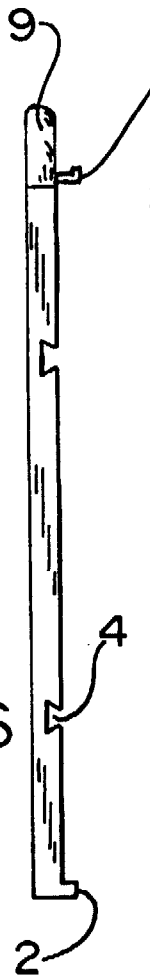
FIG. 6 side view of playing surface.

A pair of grooves 4 run across the surface and are parallel to one another. The grooves should also be parallel to the lower lip 2. The grooves are adapted to accommodate runners 5 on the side rails 3. There are two side rails which are more or less of elongate construction and should be of a length that will cover the height of the surface. The height being the distance from the top edge to the bottom edge (really lip 2) of the surface. With this in mind, the runners 5 fit in the grooves 4 so that the rails extend from top to bottom on the playing surface. With the rails in place, they are able to completely block off the sides of the playing surface and keep the puzzle pieces from coming out in the sideways direction. The grooves may be somewhat trapezoidal in shape as seen in the side view, FIG. 6. Other shapes are possible without violating the spirit of the invention.

Each of the rails has a runner that is adapted to fit one of the grooves (the grooves may be identical in size, shape, etc.) so that the rail can move across the width of the surface along the groove. Thus the rails can be adjusted to the size of the puzzle so that the puzzle will get sideways support from the rails when the rails are placed adjacent to the sides of the puzzle. Alternately, the rails may be more or less permanently attached to the grooves by use of a groove shape like that shown in FIG. 6 so that the rails cannot be removed from the surface.

The lid is preferably in pivotal connection with the planar surface. Hinges 8 may be used to accomplish this. That surface of the lid that would be in connection with the playing surface should be covered with a layer of resilient material such as: foamed polyurethane or some other resilient material so that when the lid is pushed down onto the playing surface, the foamed material will be in connection with the puzzle pieces.

Figure 7:
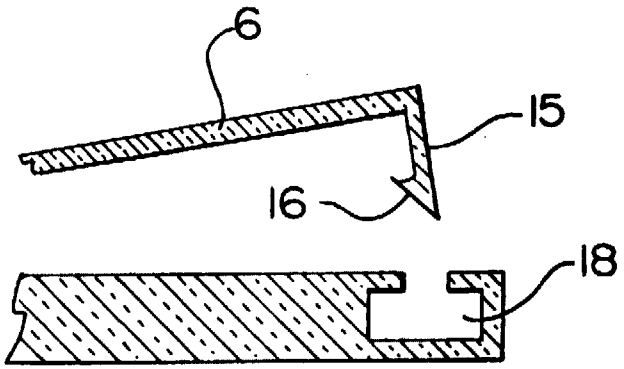
FIG. 7 Latch type of connection for lid.

The lid may be secured to the planar surface by use of various means. Latches 15 on the lid 6 and shaped like that shown in FIG. 7 are one possibility. Abutments 16 would attach to the inside of holes 18 in the planar surface or on the edges of the planar surface in order to secure the lid. The latches may be of resilient material so that the user can squeeze the latches in order for the abutment means to clear the hole and allow the lid to be detached from the surface. Latches are one possibility, other connections may be used without violating the spirit of the invention. When the lid is attached, the side rails will be in their position just outside the edge of the lid, acting as a sort of barrier.

When the apparatus is ready to use, the user should build the puzzle (i.e. interlocking the pieces) directly on the planar surface. Alternately, the user can insert a backing member, such as a piece of cardboard or posterboard (cut to size) onto the surface and create the puzzle on the backing member. The side rails should be fit onto the grooves and then adjusted to the size of the puzzle. Then the user can begin assembling the puzzle.

When the user is finished, the lid would be attached to the surface by the hinges, or slots or other means. The lid will secure the pieces on the surface until the user is ready to open the box and begin the puzzle again. It is preferred that the lid be a "one size fits all" type of lid. The rails may not be on the sides of the puzzle when the lid is lowered but the side rails will be acting as a barrier on the border of the lid.

The device may also be used to help mount the puzzle when the backing member is used. In that case, the completed puzzle is left in the box, with side rails in place and then may be covered with a coating of e.g. varnish, etc. The puzzle may be attached to the backing member through this process. The puzzle may then be lifted out for mounting, etc. The apparatus may come in many sizes including a small travel size and various sizes depending on the intended use.

I claim:

1. An apparatus for securing a puzzle comprising: a planar surface having top and bottom edges, a raised rail in connection with said surface, near one of said edges and extending in a manner perpendicular to said edges, said planar surface adapted to accommodate pieces of a puzzle; a pair of grooves running about parallel with one another and across said surface, said grooves extending in a direction parallel to said top and bottom edges and spaced apart from one another for a certain distance, a pair of side rails, each said side rail comprising an elongated portion and having at least two runner portions in connection with said elongated portion, said runner portions spaced apart from one another at a distance corresponding to said certain distance, said runner portions of shape adapted to fit each of said grooves so that said side rails may be slid along said grooves in a direction perpendicular to said grooves so as to provide for continuous varying of the distance between said side rails.

2. The apparatus of claim 1 having a lid in connection with said playing surface, said lid having a layer of foamed material so that a portion of said foamed material will be in connection with said puzzle when said lid is closed down upon said puzzle.

3. The apparatus of claim 2 wherein said lid is pivotally connected to said planar surface through at least one hinge; said lid having a means for maintaining the connection of said lid with said planar surface.

* * * * *